US010941595B2

(12) United States Patent
Patel et al.

(10) Patent No.: US 10,941,595 B2
(45) Date of Patent: Mar. 9, 2021

(54) ERGONOMIC DOOR HANDLE

(71) Applicant: Ford Global Technologies, LLC, Dearborn, MI (US)

(72) Inventors: Rajesh K. Patel, Farmington Hills, MI (US); Kosta Papanikolaou, Huntington Woods, MI (US)

(73) Assignee: FORD GLOBAL TECHOLOGIES, LLC, Dearborn, MI (US)

( * ) Notice: Subject to any disclaimer, the term of this patent is extended or adjusted under 35 U.S.C. 154(b) by 503 days.

(21) Appl. No.: 15/892,446

(22) Filed: Feb. 9, 2018

(65) Prior Publication Data

US 2019/0249471 A1 Aug. 15, 2019

(51) Int. Cl.
*E05B 85/10* (2014.01)
*E05B 79/06* (2014.01)

(52) U.S. Cl.
CPC ..... *E05B 85/107* (2013.01); *E05B 79/06* (2013.01); *E05B 85/10* (2013.01); *E05Y 2900/531* (2013.01); *Y10S 292/31* (2013.01)

(58) Field of Classification Search
CPC ..... Y10S 292/02; Y10S 292/31; E05B 85/10; E05B 85/107; E05B 1/0061; E05B 1/0069
See application file for complete search history.

(56) References Cited

U.S. PATENT DOCUMENTS 2,075,829 A * 4/1937 Ottinger ..... E05B 85/10 292/169.11
2,125,783 A * 8/1938 Heeman ..... E05B 1/0061 292/347
2,131,033 A * 9/1938 Barrington ..... E05B 85/107 70/208
2,149,375 A * 3/1939 Wiebe ..... E05B 1/0061 292/347
2,497,624 A * 2/1950 Nelson ..... E05C 1/145 292/166
2,567,565 A * 9/1951 Keeler ..... E05B 1/04 292/347
3,633,953 A * 1/1972 Gley ..... E05C 1/14 292/166
3,986,229 A * 10/1976 Gotz ..... E05B 77/34 292/336.3
3,993,338 A * 11/1976 Cherbourg ..... B60J 5/06 292/336.3

(Continued)

FOREIGN PATENT DOCUMENTS

DE 19808024 A1 * 9/1999 ..... E05B 1/00
DE 102014005797 A1 * 10/2015 ..... E05B 85/107

(Continued)

OTHER PUBLICATIONS

Pressman, Matt, "All Access Pass: The Tesla Model 3 Launch Event," Downloaded from https://evannex.com/blogs/news/114741893-all-access-pass-the-tesla-model-3-launch-event. Posted on Apr. 1, 2016.

*Primary Examiner* — Carlos Lugo
(74) *Attorney, Agent, or Firm* — David Coppiellie; Carlson, Gaskey & Olds, P.C.

(57) ABSTRACT

An example motor vehicle includes, among other things, a door having an exterior surface, and a handle moveably coupled to the door. The handle is moveable within a plane of movement oblique to the exterior surface. A door handle and a method are also disclosed.

13 Claims, 3 Drawing Sheets

(56) References Cited

U.S. PATENT DOCUMENTS 3,993,339 A * 11/1976 Cherbourg ..... E05B 5/00 292/336.3
4,475,754 A * 10/1984 Arlauskas ..... E05B 85/16 292/336.3
4,482,179 A * 11/1984 Johnson ..... E05B 1/0038 292/336.3
4,898,413 A * 2/1990 Bertolini ..... E05B 85/10 292/336.3
5,123,687 A * 6/1992 Pfeiffer ..... E05B 1/0092 292/336.3
5,558,372 A * 9/1996 Kapes ..... E05B 83/36 292/336.3
5,975,597 A * 11/1999 Makiuchi ..... E05B 85/16 292/336.3
6,148,701 A * 11/2000 Lee ..... B25G 1/105 81/177.1
6,247,385 B1 * 6/2001 Wu ..... B25B 23/16 81/177.1
6,378,921 B1 * 4/2002 Deischl ..... E05B 77/04 292/336.3
D478,494 S * 8/2003 Arnold ..... D6/583
6,886,585 B1 * 5/2005 King, Jr. ..... G05G 1/10 137/236.1
7,543,863 B2 * 6/2009 Herbert ..... E05B 85/107 292/336.3
8,403,265 B2 * 3/2013 Gowing ..... B64C 1/14 244/129.5
8,544,904 B2 10/2013 Kindig
8,807,807 B2 8/2014 Wheeler et al.
8,920,850 B2 * 12/2014 Davis ..... B65D 37/00 424/618
10,378,254 B1 * 8/2019 Salter ..... E05B 81/76
2009/0039671 A1 * 2/2009 Thomas ..... E05B 81/76 296/146.1
2013/0241215 A1 9/2013 Halliwell et al.
2015/0337571 A1 * 11/2015 Henderson ..... G07C 9/37 701/49
2017/0292297 A1 10/2017 Bartels et al.
2017/0306662 A1 * 10/2017 Och ..... E05B 81/78
2019/0218835 A1 * 7/2019 Karlein ..... E05B 85/107

FOREIGN PATENT DOCUMENTS

GB 557797 A * 12/1943 ..... E05C 1/145
JP 2016050421 A 4/2016

* cited by examiner

ERGONOMIC DOOR HANDLE

TECHNICAL FIELD

This disclosure relates to an ergonomic door handle for a motor vehicle, and a method of using the same.

BACKGROUND

Motor vehicles are known to include doors with handles, which are pulled in order to manually open the door. Typically, the handles are coupled to a cable or rod. When the handle is pulled, the cable or rod actuates a latch mechanism, which allows the user to open the door.

Vehicles include handles on both the exterior and the interior of the door. Some known exterior handles protrude outward from the exterior of the door when in an unpulled state (i.e., a resting position), and have a recess beneath the handle to accommodate a user's hand. Some other known exterior handles are flush with the exterior of the door.

SUMMARY

A motor vehicle according to an exemplary aspect of the present disclosure includes, among other things, a door having an exterior surface, and a handle moveably coupled to the door. The handle is moveable within a plane of movement oblique to the exterior surface.

In a further non-limiting embodiment of the foregoing motor vehicle, the handle includes an input section and an output section, the output section is configured to be moved outward of the exterior surface, and the handle is coupled to the door such that the output section moves downward as the output section moves outward of the exterior surface.

In a further non-limiting embodiment of any of the foregoing motor vehicles, the handle is moveably coupled to the door by a first link and a second link, the first link is moveable within a first plane and the second link is moveable within a second plane substantially parallel to the first plane, and the first and second planes are substantially parallel to the plane of movement.

In a further non-limiting embodiment of any of the foregoing motor vehicles, the first link is shorter than second the second link.

In a further non-limiting embodiment of any of the foregoing motor vehicles, the first link is curved along substantially an entirety of the length of the first link, and the second link is substantially straight along an entirety of the length of the second link.

In a further non-limiting embodiment of any of the foregoing motor vehicles, the first and second links overlap one another in a vertical direction.

In a further non-limiting embodiment of any of the foregoing motor vehicles, the door includes a fixed link, the first link is coupled to the fixed link by a first pivot point, and the second link is coupled to the fixed link by a second pivot point.

In a further non-limiting embodiment of any of the foregoing motor vehicles, the handle includes a pivot section, the input and output sections of the handle are on opposite sides of the pivot section, the first link is coupled to the pivot section by a third pivot point, and the second link is coupled to the pivot section by a fourth pivot point.

In a further non-limiting embodiment of any of the foregoing motor vehicles, the first pivot point is adjacent a first end of the fixed link, and the second pivot point is adjacent a second end of the fixed link.

In a further non-limiting embodiment of any of the foregoing motor vehicles, the fixed link lies in a plane substantially parallel to the plane of movement.

In a further non-limiting embodiment of any of the foregoing motor vehicles, a longitudinal axis of the fixed link is oblique to the exterior surface of the door.

In a further non-limiting embodiment of any of the foregoing motor vehicles, an outer surface of handle is substantially flush with the exterior surface of door when the handle is in an unpulled state.

In a further non-limiting embodiment of any of the foregoing motor vehicles, the handle includes a first side facing outward of the door and a second side opposite the first side. The second side includes a plurality of spherically-shaped projections.

A door handle configured to be moveably coupled to a door of a motor vehicle according to an exemplary aspect of the present disclosure includes, among other things, a first side configured to face outward of the door and a second side opposite the first side. The second side includes a plurality of spherically-shaped projections.

In a further non-limiting embodiment of the foregoing door handle, the handle includes an input section and an output section, the input section is oblique to the output section, and the second side of the output section includes the spherically-shaped projections.

In a further non-limiting embodiment of any of the foregoing door handles, the spherically-shaped projections are integrally formed with a remainder of handle.

A method according to an exemplary aspect of the present disclosure includes, among other things, moving a handle outward of an exterior surface of a door. Further, the handle moves downward as it moves outward.

In a further non-limiting embodiment of the foregoing method, the handle is initially moved outward by a user pressing on an input section of the handle.

In a further non-limiting embodiment of any of the foregoing methods, the handle is further moved outward by a user pulling on an output section of the handle. The input and output sections are on opposite sides of a pivot section of the handle.

In a further non-limiting embodiment of any of the foregoing methods, the movement of the handle is guided by a first link and a second link. The first and second links are coupled to the door and the handle.

BRIEF DESCRIPTION OF THE DRAWINGS

FIG. 2 is an exterior perspective view of the section of the motor vehicle.

FIG. 3 is a side view of the section of the motor vehicle.

FIG. 4 is an interior perspective view of the section of the motor vehicle.

FIG. 5 is a top view of the section of the motor vehicle.

DETAILED DESCRIPTION

This disclosure relates to an ergonomic door handle for a motor vehicle, and a method of using the same. An example motor vehicle includes a door having an exterior surface, and a handle moveably coupled to the door. The handle is moveable within a plane of movement oblique to the exterior surface of the door. The arrangement of the handle relative to the door provides an ergonomic handle. One particular benefit is that when a user moves the handle outward, the handle moves downward so as to not interfere with the user's fingers. Rather, the downward movement of the handle allows the user to wrap their fingers around the handle with relative ease. Further, the arrangement of the handle allows the user to pull the handle with relative ease and using a more natural movement. In another aspect of this disclosure, the feel of the handle is improved, leading to increased comfort and customer satisfaction.

Figure 1:
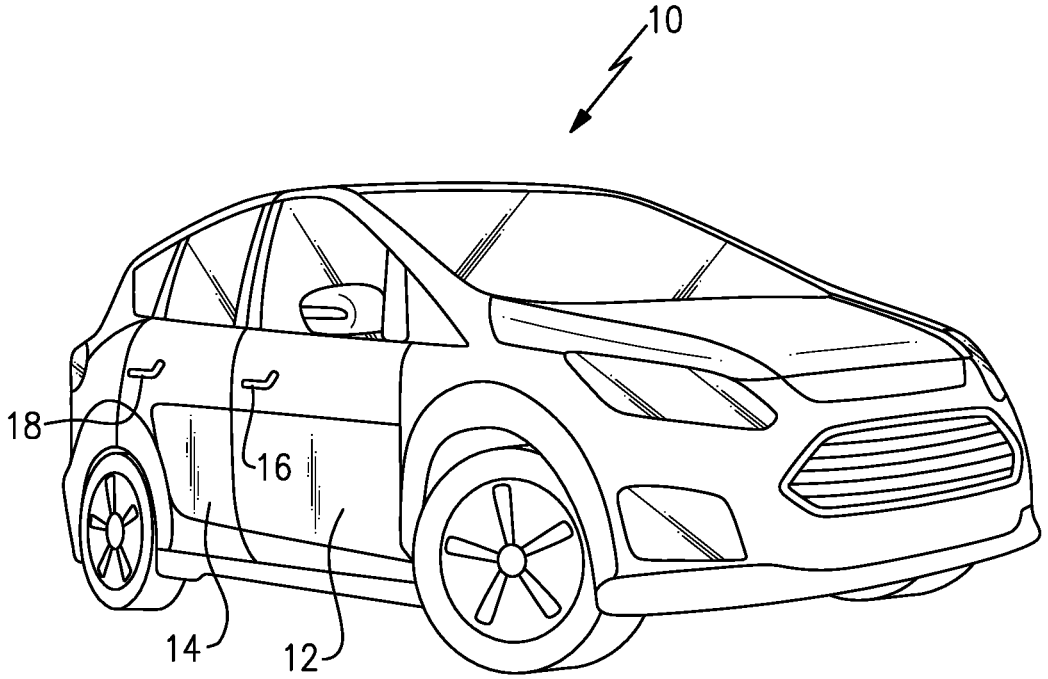
FIG. 1 is a perspective view of an exemplary motor vehicle.

Referring to the drawings, FIG. 1 is a perspective view of a motor vehicle 10. The motor vehicle 10 in this example is a four door sedan. FIG. 1 shows a front passenger door 12 and a rear passenger door 14. Each of the doors 12, 14 includes a handle 16, 18 on an exterior thereof. The handles 16, 18 are moveably coupled to a respective door 12, 14, and are configured to cooperate with a mechanism to open the door. The mechanism may include a rod or a cable coupled to a latch, as one example. While a sedan is shown in FIG. 1, it should be understood that this disclosure extends to all vehicle types, including cars, trucks, vans, sport utility vehicles (SUVs), etc. Further, while a four door vehicle is shown in FIG. 1, this disclosure extends to vehicles having at least one door.

FIGS. 2-5 are close-up views of a section of the door 12 including the handle 16. In FIGS. 2-5, the handle 16 is in an unpulled state. The handle 16 is biased to the unpulled state under the force of a biasing member, such as a spring, in some examples. The handle 16 is moveable relative to the door 12 upon application of force by a user, which overcomes the force of the biasing member. While FIGS. 2-5 show only one handle (i.e., the handle 16), it should be understood that the handle 18, and any other exterior handles of the vehicle 10, including a handle on the driver's door, may be arranged similarly. Further, and as will be appreciated from the below, the handle 16 is configured specifically for use with a user's left hand. It should be understood that the handle 16 could essentially be reflected along a vertical line (i.e., a line extending up-and-down, relative to FIG. 2), and thereby be configured to use with a user's right hand. This disclosure extends to left-hand and right-hand handles.

Figure 2:
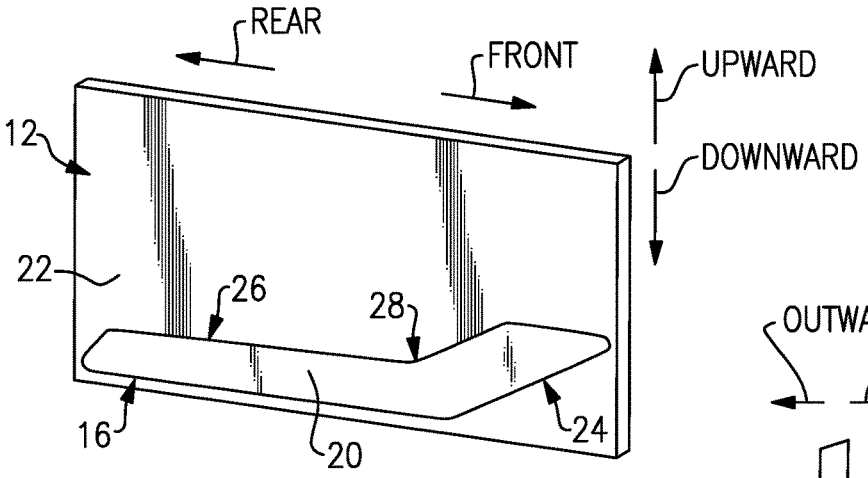
FIGS. 2-5 are close-up views of a section of the motor vehicle, and in particular illustrate a handle in an unpulled state.
Figure 4:
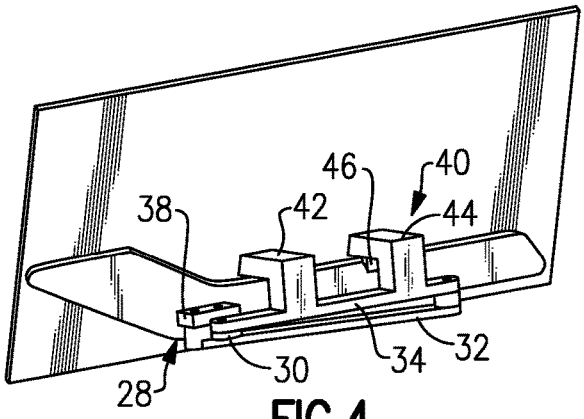
Figure 3:
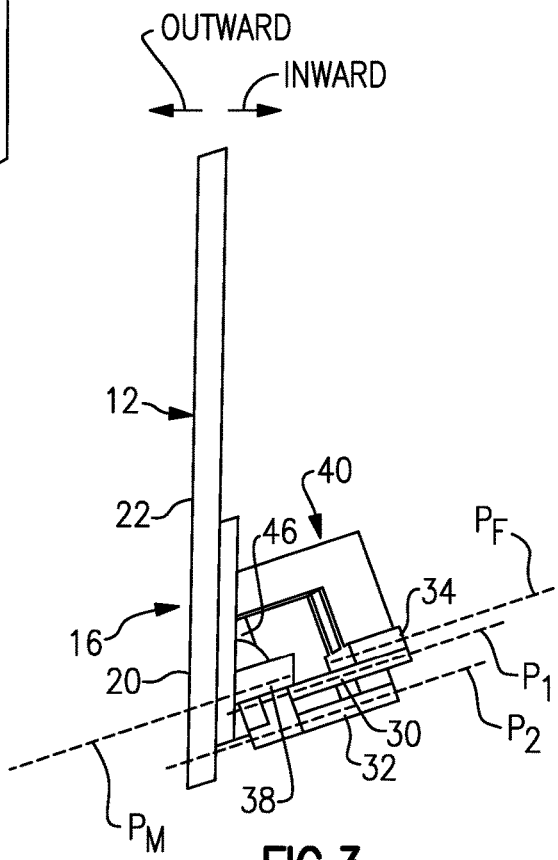

With reference to FIGS. 2 and 3, the handle 16 is a flush exterior door handle in this example. That is, when the handle 16 is in an unpulled state, an outer surface 20 of handle 16 is substantially flush with an exterior surface 22 of the door 12. As shown in FIG. 3, the outer surface 20 does not project outward beyond the exterior surface 22.

With specific reference to FIG. 2, the handle 16 includes an input section 24 and an output section 26. The handle 16 further includes a pivot section 28 between the input section 24 and the output section 26. In this example, the input section 24 is in front of the pivot section 28, and the output section 26 is to the rear of the pivot section 28. The "front" and "rear" directions are labeled in FIG. 2 for ease of reference. The input section 24 is inclined and oblique to the output section 26, and specifically is inclined upward relative to the output section 26. Further, the output section 26 is longer than the input section 24. In general, the shape of handle 16 resembles a hockey stick in this example.

Upon application of force, the handle 16 is configured to rotate about the pivot section 28 such that the output section 26 moves outward of the exterior surface 22 of the door 12, and the input section 24 moves inward of the exterior surface 22, as will be discussed below. The "outward" and "inward" directions are labeled in FIG. 3 for ease of reference. Further, a lock cylinder may be incorporated into the output section 26.

The handle 16 is moveably coupled to the door 12 within a plane of movement $P_M$ oblique to the exterior surface 22. The term "oblique" is used in this disclosure consistent with its plain and ordinary meaning, which is neither perpendicular nor parallel. Further, reference to the exterior surface 22 is a reference to the portions of the exterior surface 22 adjacent the handle 16, such as those portions shown in FIGS. 2 and 3. Such portions of the exterior surface 22 may be formed of sheet metal, for example. By coupling the handle 16 to the door 12 in this way, the ergonomics of the handle 16 are improved relative to prior designs, and the handle 16 can be pulled using a more natural motion, as generally mentioned above.

In this disclosure, the handle 16 is moveably coupled to the door 12 by way of a linkage arrangement, which is configured to guide movement of the handle 16. In the illustrated example, the linkage arrangement includes a first link 30 and a second link 32. As perhaps best seen in FIGS. 4 and 5, the first and second links 30, 32 are coupled to a fixed link 34 and to an inner surface 36 of the handle 16. Specifically, the first and second links 30, 32 are coupled to a tab 38 projecting from the handle 16 adjacent the pivot section 28.

Figure 5:
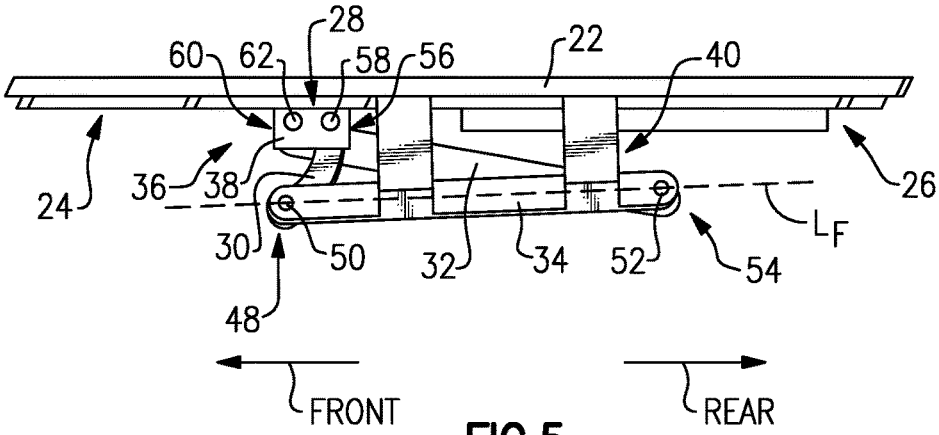

The fixed link 34 is spaced-apart inward of the exterior surface 22 of the door 12, and is supported by a chassis 40. With reference to FIG. 5, the chassis 40 supports the fixed link 34 such that the fixed link 34 extends along a longitudinal axis $L_F$, which is oblique to the exterior surface 22 of the door 12. The chassis 40 includes first and second legs 42, 44 supporting the fixed link 34. The first and second legs 42, 44 are substantially L-shaped in this example. The chassis 40 supports the fixed link 34 such that it is rigidly supported, and does not move relative to the door 12. Further, in this example, the second leg 44 includes a tab 46 configured to restrict inward movement of the output section 26 of the handle 16.

With reference to FIG. 3, the fixed link 34 lies in a plane $P_F$ substantially parallel to the plane of movement $P_M$. Further, the first and second links 30, 32 are rotatably coupled to the fixed link 34 and the tab 38 such that they move within first and second planes $P_1$, $P_2$, respectively. The planes $P_1$, $P_2$ are also substantially parallel to the plane of movement $P_M$. Accordingly, the first and second planes $P_1$, $P_2$, the plane $P_F$, and the plane of movement $P_M$ are substantially parallel to one another, and each are oblique to the exterior surface 22 of the door 12.

The first and second links 30, 32 are arranged to guide movement of the handle 16. In this disclosure, the first link 30 is shorter than second the second link 32. Further, the first link 30 is curved along substantially its entire length, while the second link 32 is straight along substantially its entire length. The first and second links 30, 32 are rotatably coupled to the fixed link 34 and the tab 38. Specifically, with reference to FIG. 5, the first link 30 is coupled to the fixed link 34 adjacent a front end 48 thereof by a first pivot point 50, and the second link is coupled to the fixed link 34 adjacent a rear end 52 thereof by a second pivot point 54. Further, the first link 30 is coupled to the tab 38 adjacent a rear end 56 thereof by a third pivot point 58, and the second link 32 is coupled to the tab 38 adjacent a front end 60 thereof by a fourth pivot point 62. Reference to a "pivot point" in this disclosure includes a reference to any known type of rotatable connection, including connections having a pin, shaft, or hinge, as examples.

In the illustrated example, the first and second links 30, 32 overlap one another in a vertical direction. Specifically, the first link 30 and the first plane $P_1$ are upward of the second link 32 and the second plane $P_2$. It should be understood that the second link 32 could be arranged upward of the first link 30, however.

The arrangement of the first link 30, the second link 32, the fixed link 34, and the handle 16 provides a four bar linkage arrangement. Specifically, the disclosed arrangement behaves like a Grashof double rocker linkage. This disclosure is not limited to Grashof linkage arrangements, however.

Figure 6:
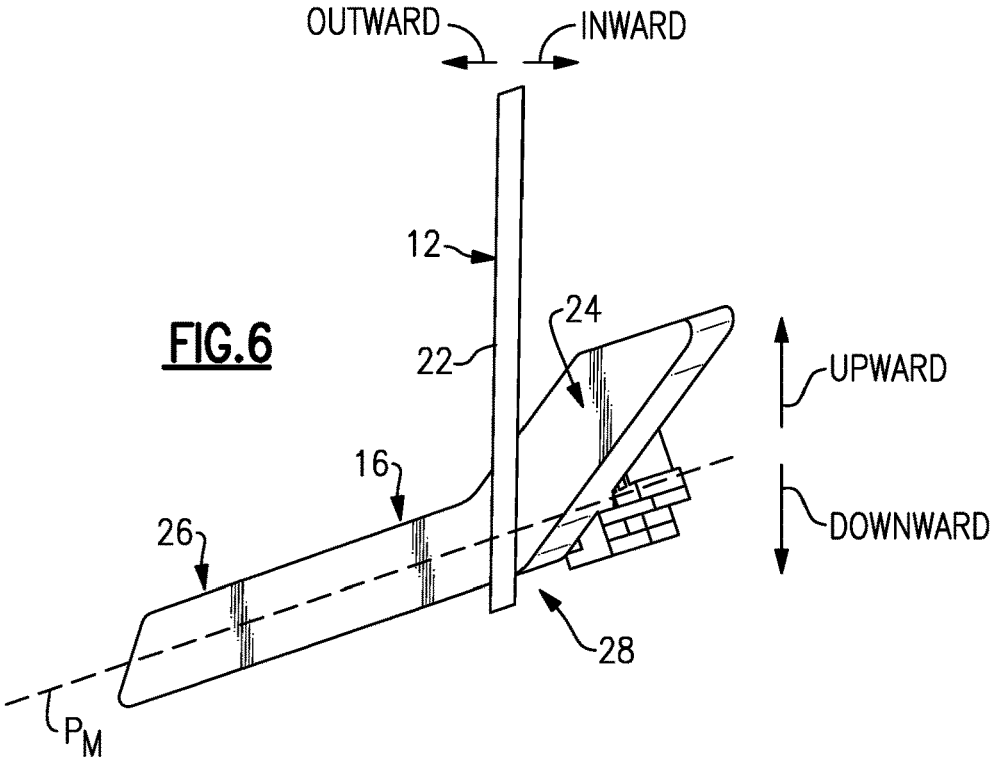
FIG. 6 is a side view of the section of the motor vehicle with the handle in a pulled state.

FIG. 6 illustrates the same section of the door 12 as in FIGS. 2-5, but with the handle 16 in a pulled state. That is, FIG. 6 is representative of a state in which a user has pulled the handle 16 and overcome the bias of the handle 16 to the unpulled state. In the position of FIG. 6, a latch for the door 12 may have been released, allowing the user to open the door 12.

In order to move the handle 16 from the unpulled state to the pulled state of FIG. 6, a user first presses the input section 24 inward with the thumb of their left hand, for example. In this disclosure, the input section 24 is sized to accommodate an average human thumb. Pressing the input section 24 inward rotates the handle 16 about the pivot section 28, and moves the output section 26 outward relative to the exterior surface 22 of the door 12. Because the handle 16 is coupled to the door 12 such that is moves within a plane of movement $P_M$ oblique to the exterior surface 22, the output section 26 moves downward as it moves outward. Likewise, the input section 24 moves upward as it moves inward.

Because the output section 26 moves downward, it is relatively easy for a user to wrap the fingers of their left hand around the output section 26. Specifically, since the output section 26 moves downward relative to the input section 24, where the left thumb is located, the output section 26 does not interfere with, or hit, the user's left fingers. To this end, the output section 26 has a length to accommodate the fingers of an average human hand. Again, while the handle 16 is configured for use with a left hand, this disclosure extends to handles configured for use with a right hand.

With their fingers wrapped around the output section 26, the user can pull the output section 26 to open the door 12. As the user pulls the output section 26, the output section 26 continues to move outward and downward within the plane of movement $P_M$, which is a natural movement for the user. Such movement is substantially easier and more natural than the upward pulling motion required of most vehicle door handles.

Figure 7:
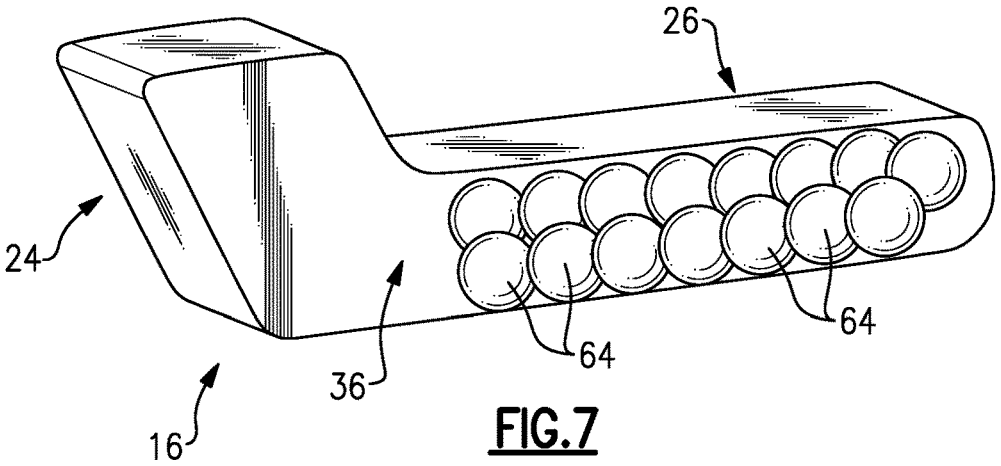
FIG. 7 is a perspective view of an exemplary aspect of the disclosed handle.
Figure 8:
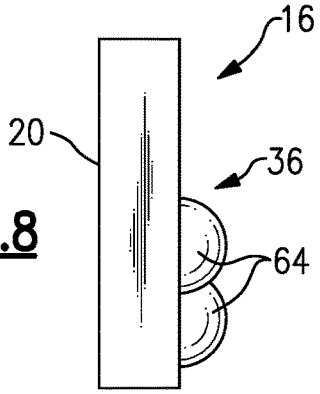
FIG. 8 is a side view of the handle of FIG. 7.

FIG. 7 illustrates another aspect of the present disclosure. In FIG. 7, an inner surface 36 of the output section 26 of the handle 16 includes a plurality of spherically-shaped projections 64. The projections 64 jut out from the remainder of the handle 16, as perhaps best seen in FIG. 8. The spherically-shaped projections 64 may be semi-spherical in some examples. The inner surface 36 of the output section 26 may be substantially covered with the spherically-shaped projections 64. While substantially covered with the spherically-shaped projections 64, overall the inner surface 36 of the output section 26 follows a substantially convex contour.

The handle 16 is integrally formed with the spherically-shaped projections 64 in one example. For instance, the handle 16 may be formed by injection molding, and in that case the handle 16, including the spherically-shaped projections 64, would be integrally molded during a single manufacturing process.

The spherically-shaped projections 64 may be coated with a material different than that of the remainder of the handle 16, such as a softer material. Further, the spherically-shaped projections 64 may be formed by an overmolding process, in which the remainder of the handle 16 has already been formed in a first manufacturing process, and then the spherically-shaped projections 64 are molded over the preexisting piece to form a combined part.

The spherically-shaped projections 64 are configured to contact the fingertips of a user when the user pulls the handle 16. The texture provided by the spherically-shaped projections 64 is pleasing to the user, and also provides the user with an improved grip. It should be noted that the spherically-shaped projections 64 are not limited to use only with flush handles, such as the handle 16. The spherically-shaped projections 64 can be incorporated into other types of vehicle handles.

It should be understood that terms such as "about," "substantially," and "generally" are not intended to be boundaryless terms, and should be interpreted consistent with the way one skilled in the art would interpret those terms. It should also be understood that terms such as "outward," "inward," "front," "rear," "upward," "downward," etc., are used herein relative to the normal, upright operational attitude of the vehicle 10 for purposes of explanation only, and should not be deemed limiting.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A motor vehicle, comprising:

a door having an exterior surface; and a handle moveably coupled to the door, the handle moveable between an unpulled state and a pulled state within a plane of movement oblique to the exterior surface, wherein the handle includes an input section, an output section, and a pivot section between the input section and the output section, and wherein, when moving from the unpulled state to the pulled state, the handle is configured to rotate about the pivot section such that the input section moves inward of the exterior surface and the output section moves outward of the exterior surface, and further such that the input section moves upward and the output section moves downward, relative to positions of the input and output sections in the unpulled state, wherein the handle is moveably coupled to the door by a first link and a second link, wherein the first link is moveable within a first plane and the second link is moveable within a second plane substantially parallel to the first plane, and wherein the first and second planes are substantially parallel to the plane of movement.

2. The motor vehicle as recited in claim 1, wherein the first link is shorter than second the second link.

3. The motor vehicle as recited in claim 1, wherein:

the first link is curved along substantially an entirety of the length of the first link, and the second link is substantially straight along an entirety of the length of the second link.

4. The motor vehicle as recited in claim 1, wherein the first and second links overlap one another in a vertical direction.

5. The motor vehicle as recited in claim 1, wherein:

the door includes a fixed link, the first link is coupled to the fixed link by a first pivot point, and the second link is coupled to the fixed link by a second pivot point.

6. The motor vehicle as recited in claim 5, wherein:

the first link is coupled to the pivot section by a third pivot point, and the second link is coupled to the pivot section by a fourth pivot point.

7. The motor vehicle as recited in claim 6, wherein:

the first pivot point is adjacent a first end of the fixed link, and the second pivot point is adjacent a second end of the fixed link.

8. The motor vehicle as recited in claim 6, wherein the fixed link lies in a plane substantially parallel to the plane of movement.

9. The motor vehicle as recited in claim 8, wherein a longitudinal axis of the fixed link is oblique to the exterior surface of the door.

10. The motor vehicle as recited in claim 1, wherein, when the handle is in the unpulled state, an outer surface of handle is substantially flush with the exterior surface of door.

11. The motor vehicle as recited in claim 1, wherein the handle includes a first side facing outward of the door and a second side opposite the first side, the second side including a plurality of spherically-shaped projections.

12. A method, comprising:

pulling a handle outward of an exterior surface of a door from an unpulled state to a pulled state, wherein the handle includes an input section, an output section, and a pivot section between the input section and the output section, and wherein, when pulling the handle outward from the unpulled state to the pulled state, the handle rotates about the pivot section such that the input section moves inward of the exterior surface and the output section moves outward of the exterior surface, and further such that the input section moves upward and the output section moves downward, relative to positions of the input and output sections in the unpulled state, wherein the handle is initially moved outward by a user pressing on the input section, wherein the handle is further moved outward by the user pulling on the output section, and wherein the movement of the handle is guided by a first link and a second link, the first and second links coupled to the door and the handle.

13. The motor vehicle as recited in claim 1, wherein:

the handle is biased to the unpulled state, and the handle is configured to move to the pulled state upon an application of force by a user overcoming the bias of the handle to the unpulled state.

* * * * *